US005207498A

United States Patent [19]

Lawrence et al.

[11] Patent Number: 5,207,498

[45] Date of Patent: May 4, 1993

[54] VACUUM CLEANER HEADLIGHT

[75] Inventors: Randall K. Lawrence, Bristol, Tenn.; Timothy W. Jackson, Bristol, Va.; Ronald L. Sitzema, Jr., Ellsworth, Mich.

[73] Assignee: Electrolux Corporation, Marietta, Ga.

[21] Appl. No.: 750,304

[22] Filed: Aug. 27, 1991

[51] Int. Cl.[5] ..... F21V 7/04; A47L 9/30

[52] U.S. Cl. ..... 362/91; 362/32; 362/296; 362/307; 362/309; 362/311; 362/339; 362/341; 15/324; 385/901; 385/146

[58] Field of Search ..... 362/31, 23, 26, 27, 362/29, 30, 91, 32, 253, 296, 307, 309, 311, 328, 339, 341; 15/324; 55/DIG. 3, 274; 385/901, 146, 133

[56] References Cited

U.S. PATENT DOCUMENTS

| | | | |
|---|---|---|---|
| 1,028,721 | 6/1912 | Heisey et al. | 362/310 |
| 2,208,523 | 7/1940 | Cullman | 240/2 |
| 2,217,174 | 10/1940 | Langille | 240/2 |
| 2,274,971 | 3/1942 | White | 240/2 |
| 2,471,800 | 5/1949 | von Mulinen | 88/24 |
| 2,475,400 | 7/1949 | Osborn | 40/130 |
| 2,480,178 | 8/1949 | Zinberg | 240/1 |
| 2,673,288 | 3/1954 | Stevens et al. | 240/41.36 |
| 2,730,750 | 1/1956 | Briere | 15/324 |
| 2,737,573 | 3/1956 | Olthuis | 240/2.1 |
| 3,278,738 | 10/1966 | Clark | 240/2 |
| 3,546,438 | 12/1970 | Buc et al. | 235/61.11 |
| 3,619,591 | 11/1971 | Korski | 240/2 |
| 4,282,560 | 8/1981 | Kringel et al. | 362/26 |
| 4,322,781 | 3/1982 | Peterson | 362/32 |
| 4,460,939 | 7/1984 | Murakami et al. | 362/31 |
| 4,528,617 | 7/1985 | Blackington | 362/32 |
| 4,642,736 | 2/1987 | Masuzawa et al. | 362/31 |
| 4,716,507 | 12/1987 | Ames | 362/311 |
| 4,757,574 | 7/1988 | Sumerau | 15/324 |
| 4,791,700 | 12/1988 | Bigley et al. | 15/324 |
| 4,805,984 | 2/1989 | Cobb, Jr. | 385/133 |
| 4,834,495 | 5/1989 | Whitehead et al. | 385/133 |
| 4,914,553 | 4/1990 | Hamada et al. | 362/32 |
| 4,991,918 | 2/1991 | Owen et al. | 350/96.10 |
| 4,996,632 | 2/1991 | Aikens | 362/32 |
| 5,005,108 | 4/1991 | Pristash et al. | 362/31 |
| 5,009,475 | 4/1991 | Knudson | 350/96 |
| 5,107,565 | 4/1992 | Chun | 15/324 |

*Primary Examiner*—Ira S. Lazarus
*Assistant Examiner*—L. Heyman
*Attorney, Agent, or Firm*—Jeffrey H. Ingerman

[57] ABSTRACT

A vacuum cleaner headlight system incorporating a light pipe is provided. The light pipe includes reflex optics to control the distribution of light across the width of the output edge of the light pipe, as well as to prevent light from escaping through the sides of the light pipe. A reflex optical reflector is also part of the system, for reflecting light from a light bulb into the light pipe without requiring a metallized mirror.

122 Claims, 9 Drawing Sheets

VACUUM CLEANER HEADLIGHT

BACKGROUND OF THE INVENTION

This invention relates to vacuum cleaner headlights. In particular, this invention relates to a vacuum cleaner headlight assembly including a light pipe.

It is well known to include a headlight at the front of a vacuum cleaner to illuminate the surface to be cleaned. Such headlights are particularly useful to illuminate corners of rooms where the ambient light is not that bright, and for cleaning under furniture. Headlights can be provided both on the base of an upright vacuum cleaner and on the motor-driven nozzle of a canister vacuum cleaner. Hereafter, the term "vacuum cleaner" will be used to refer to both the base of an upright vacuum cleaner and the motor-driven nozzle of a canister vacuum cleaner, unless otherwise noted.

The simplest and most common form of vacuum cleaner headlight includes one or more bulbs mounted behind a lens near the front of the vacuum cleaner. In such a headlight the bulbs are usually mounted in a reflector housing. To be most useful, the headlight must illuminate the area immediately in front of the vacuum cleaner. To achieve that result, the bulb and lens are placed as far forward as possible to avoid casting the shadow of the vacuum cleaner itself on the floor in front of the vacuum cleaner. However, the size of the bulb and reflector housing can add significantly to the height of the vacuum cleaner, making it more difficult for the vacuum cleaner to be used under furniture. For that reason, in some cases the bulb is moved further back, but that results in shadows in the area immediately in front of the vacuum cleaner, which is precisely the area to be cleaned.

It is also known to use light pipes in vacuum cleaner headlights. In such a headlight system, the bulb can be placed within the body of the vacuum cleaner remote from the front face, and the light is conducted to the front face by a light pipe, which is an optical waveguide, usually rigid, formed from glass, quartz, or optical grade plastics such as methacrylate plastics.

However, in known vacuum cleaner light pipe headlight systems, the light exiting the front face of the light pipe tended to be concentrated directly in front of the bulb, so that even if the light pipe exit end were wide, the light pattern would not cover the full area in front of the vacuum cleaner. To provide a useful distribution of light, it has been known to use multiple bulbs and, in at least one case, multiple light pipes across the width of the vacuum cleaner.

It would be desirable to be able to provide a vacuum cleaner headlight which does not excessively increase the height of the front of a vacuum cleaner.

It would also be desirable to be able to provide a vacuum cleaner headlight which illuminates the area immediately in front of the vacuum cleaner.

It would further be desirable to be able to provide a vacuum cleaner headlight which has an even distribution of light across the width of the vacuum cleaner.

It would still further be desirable to provide such a vacuum cleaner, incorporating a light pipe, which only required one light pipe and one light bulb or other light source.

SUMMARY OF THE INVENTION

It is an object of this invention to provide a vacuum cleaner headlight which does not excessively increase the height of the front of a vacuum cleaner.

It is also an object of this invention to provide a vacuum cleaner headlight which illuminates the area immediately in front of the vacuum cleaner.

It is a further object of this invention to provide a vacuum cleaner headlight which has an even distribution of light across the width of the vacuum cleaner.

It is a still further object of this invention to provide such a vacuum cleaner, incorporating a light pipe, which only requires one light pipe and one light bulb or other light source.

In accordance with this invention, there is provided a vacuum cleaner assembly including a housing having a front wall, a light pipe chamber within the housing communicating with a headlight aperture in the front wall, a light source within the housing remote from the headlight aperture, and a substantially planar light pipe within the light pipe chamber. The light pipe has a first index of refraction, a rear face adjacent the light source for receiving light from the light source, a front face disposed substantially in the headlight aperture through which light is emitted, and an upper surface and a lower surface. At least one of the upper and lower surfaces has primary reflex optical elements thereon for distributing light entering the rear face in a desired distribution to the front face.

A reflex optical reflector is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
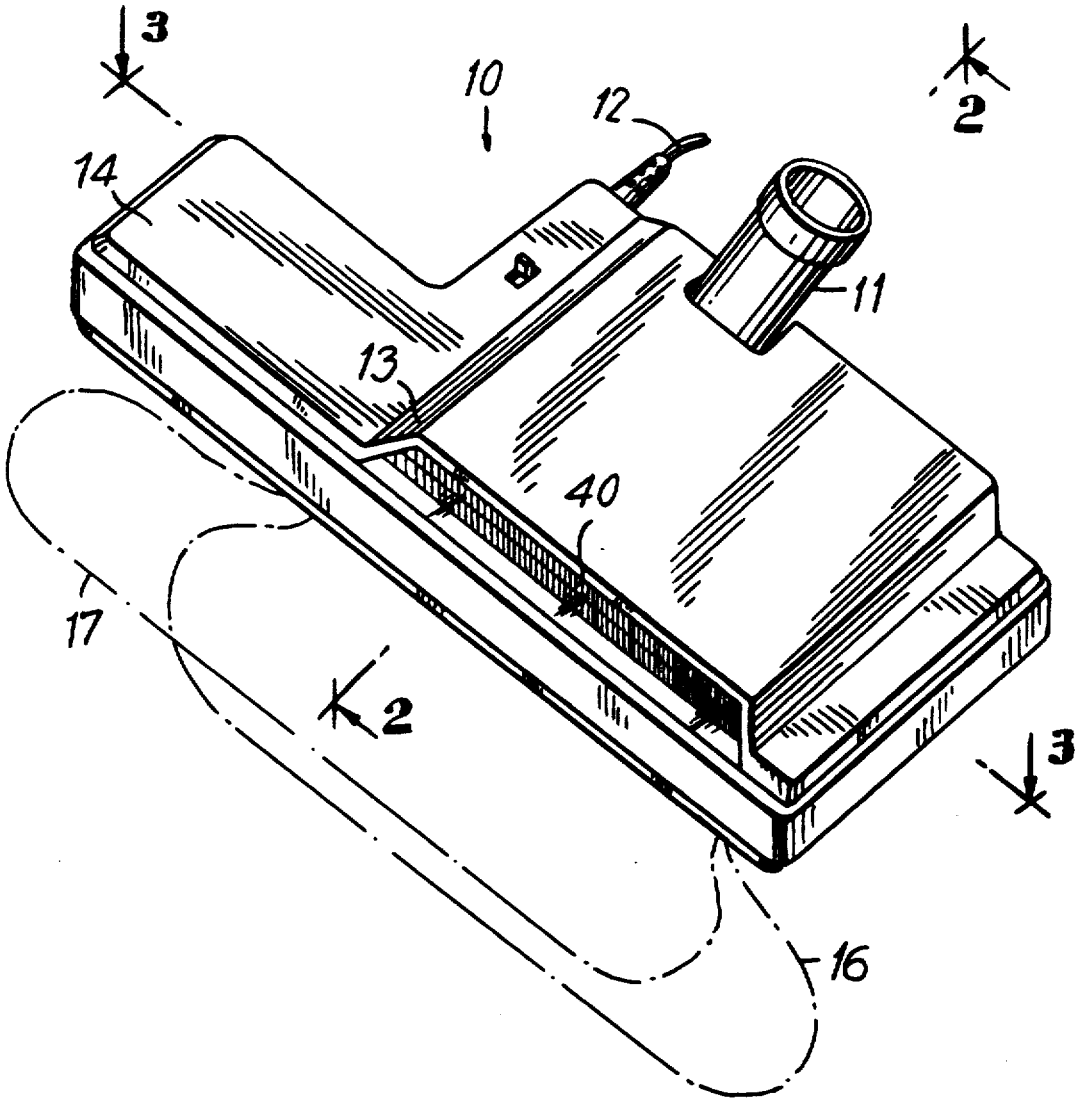
FIG. 1 is a perspective view of a vacuum cleaner incorporating the headlight system of the present invention.

The vacuum cleaner headlight system of the present invention provides substantially uniform illumination on the floor in front of a vacuum cleaner, as close as possible to the vacuum cleaner, by using a light pipe to horizontally distribute light from a light source, such as a bulb, within the vacuum cleaner and to project it from the front of the vacuum cleaner onto the floor.

As discussed in part above, a light pipe is a molded optical waveguide, usually rigid, formed from any optical grade light transmissive material. Like optical waveguide fibers ("fiber optics"), light pipes can direct light because of the phenomenon of total internal reflection, which is a consequence of Snell's Law of Refraction.

According to Snel's Law, light travelling from a first medium having a first index of refraction to a second medium having a second different index of refraction, and approaching the interface between those media at a non-zero angle relative to a line normal to the interface, will change directions at the interface because of refraction. If the second index of refraction is greater than the first, the angle between the refracted light rays and the normal line will be smaller in the second medium than it was in the first medium. If the second index of refraction is less than the first, the angle between the refracted light rays and the normal line will be greater in the second medium than it was in the first medium.

Snell's Law can be expressed mathematically as follows:

$$n_1 \sin \theta_1 = n_2 \sin \theta_2,$$

where $n_1$ and $n_2$ are the indices of refraction in the first and second media, respectively, and $\theta_1$ and $\theta_2$ are angles between the normal and the incident and refracted light rays, respectively, otherwise known as the "angle of incidence" and the "angle of refraction."

Total internal reflection occurs when light is passing from a medium of higher index of refraction to one of lower index of refraction and the angle of refraction ($\theta_2$) reaches, or just exceeds, 90°, at which point the light ray is refracted so far from the normal that it is effectively reflected back into the first medium. Because $\sin(90°)=1$, this occurs when:

$$n_1 \sin\theta_1 = n_2,$$

so that total internal reflection occurs, for two media having indices of refraction $n_1$ and $n_2$, when the angle of incidence just exceeds $$\theta_1 = \sin^{-1}(n_2/n_1).$$

This angle will obviously differ for each pair of media having different indices of refraction.

As an approximation to most of the optical grade materials that can be used in the present invention, glass has an index of refraction of approximately 1.5, while air has an index of refraction of approximately 1 (the index of refraction of a vacuum is exactly 1). Therefore, for light rays traveling in glass, total internal reflection occurs when the angle of incidence exceeds $$\theta_1 = \sin^{-1}(1/1.5) = \sin^{-1}(2/3) = 41.8°.$$

Thus for a light pipe of glass or an optical medium of similar index of refraction, only those light rays having angles of incidence of less than 41.8° would escape through the sides of the waveguide. If the direction of the light rays that enter through the entrance end of the light pipe are sufficiently well-controlled, one can almost guarantee that no light rays will escape before reaching the exit end. Only those light rays that enter at random angles (e.g., light rays from ambient sources) might be sufficiently close to being perpendicular to the side walls of the light pipe to escape. If the dimension of the light pipe perpendicular to the direction of desired transmission of light is small enough, only a small number of random light rays will escape near the entrance end of the light pipe.

Previously known light pipes did not control the lateral distribution of the light passing through the light pipe. That is, for a light pipe of high aspect ratio—much wider in a first direction perpendicular to the direction of light travel than it is in a second direction perpendicular to the direction of light travel, previously known vacuum cleaner light pipes did nothing to control the distribution of light in the first direction, or indeed to prevent the escape of light out the side walls in that direction. As a result, there was some leakage out the sides of previously known vacuum cleaner light pipes and, more importantly, light exiting the previously known light pipes tended to be concentrated at points along the width of the exit end that were directly opposite the points along the width of the entrance end at which the light sources were located.

The present invention addresses these difficulties of high-aspect ratio light pipes by providing reflex optical elements on surfaces of the light pipe, using total internal reflection to increase control of light propagating through the light pipe. Reflex optical elements are optical elements that reflect light.

In the present invention, the reflex optical elements are triangular prismatic elements arranged along lines extending substantially radially from a single point. behind the entrance end of the light pipe. The light source of the vacuum cleaner is intended to be mounted at this virtual center point of the array of prismatic elements. The prismatic elements in the preferred embodiment have cross sections that are substantially isosceles right triangles, although they need not be. The apex angle of the prismatic elements is chosen so that in addition to preventing light from escaping from the light pipe, total internal reflection keeps light within the prismatic elements. The prismatic elements thereby become channels for collimating the light into a desired distribution at the front face of the light pipe. By shaping the entrance end so that light enters substantially uniformly across the entrance end, light can be directed to exit substantially uniformly across the exit end. In the case of a vacuum cleaner headlight, this results in more uniform lighting.

Figure 2:
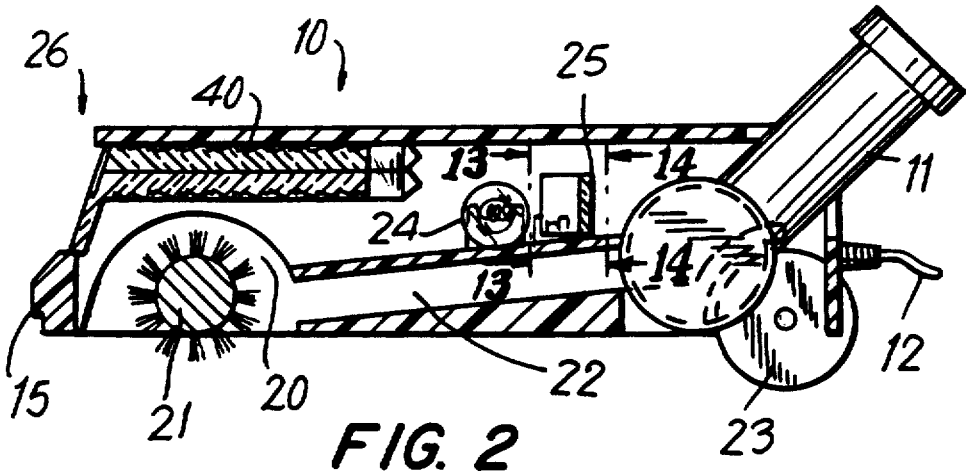
FIG. 2 is a vertical cross-sectional view of the vacuum cleaner of FIG. 1, taken from line 2—2 of FIG. 1.
Figure 3:
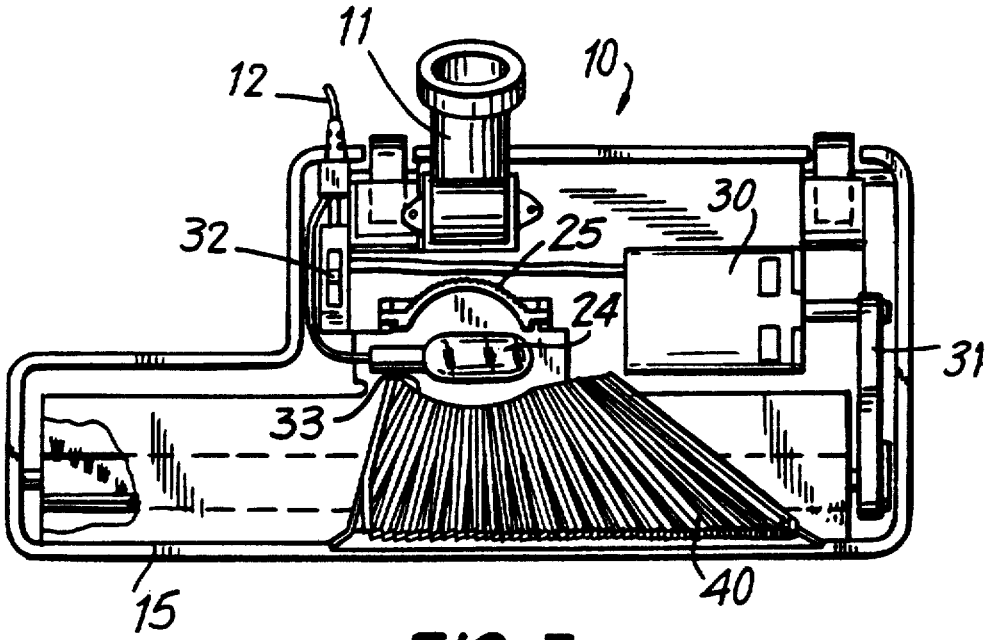
FIG. 3 is a horizontal cross-sectional view of the vacuum cleaner of FIGS. 1 and 2, taken from line 3—3 of FIG. 1.
Figure 4:
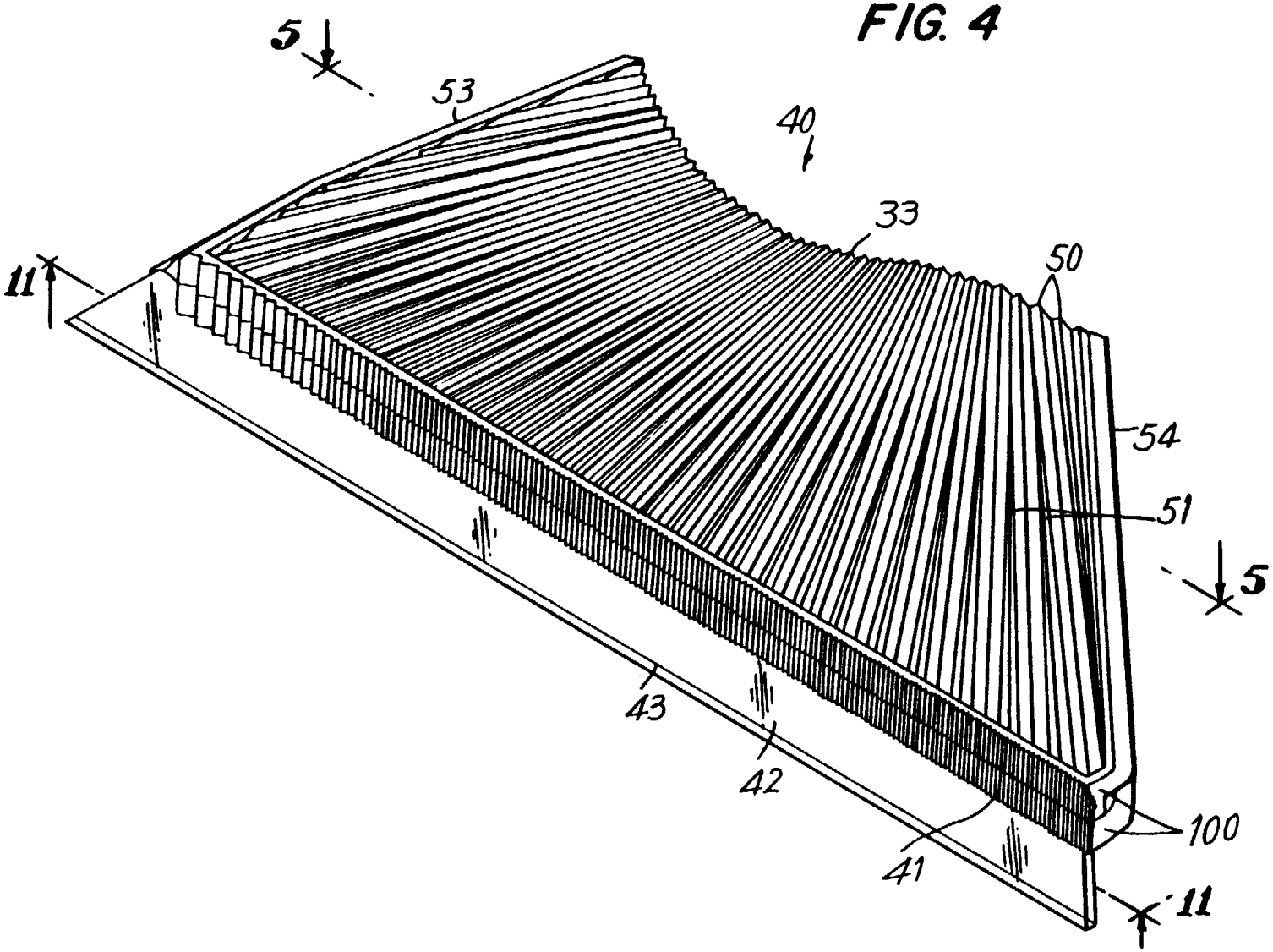
FIG. 4 is a perspective view of a light pipe according to the present invention.

A vacuum cleaner assembly 10 incorporating a light pipe 40 according to the present invention is shown in FIGS. 1-3. As explained above, the present invention can be used in the motor-driven nozzle of a canister vacuum cleaner, or in the base of an upright vacuum cleaner; vacuum cleaner assembly 10 as shown in the drawings is a motor-driven nozzle.

Motor-driven nozzle 10 has a suction chamber 20 housing a rotating (when operating) agitator brush 21. Brush 21 helps dislodge dirt from the surface to be cleaned, which is then sucked through suction passage 22 into connector 11, which connects to the wand and suction hose (neither shown) of a canister vacuum unit. Wheels 23 (one shown) make it easier to move motor-driven nozzle 10 over the surface to be cleaned. Power cord 12 provides power to motor 30 which drives brush 21 via belt 31. Switch 32 can be provided to turn motor 30 on and off, depending on the nature of the surface to be cleaned (e.g., carpeted or not carpeted), and possibly to change the speed of motor 30. Light bulb 24 illuminates the surface to be cleaned through light pipe 40 in accordance with the invention. A reflector 25, which according to a preferred embodiment of the invention employs reflex optics, reflects light from bulb 24 through light pipe 40. A bumper strip 15 extends around the perimeter of motor-driven nozzle 10 to protect furniture and walls from impacts with motor-driven nozzle 10.

It is desirable for the front 26 of motor driven nozzle 10 (or of an upright vacuum cleaner base) to be as low as possible to maximize the utility of the vacuum cleaner for cleaning under furniture and beds. Suction chamber 20 contributes a certain minimum height, and a traditional headlight would add too much height for motor-driven nozzle 10 to be truly useful if the headlight were at the front edge 26. And if the headlight were not at the front edge 26, front edge 26 would cast a shadow in the surface to be cleaned that would prevent illumination of the immediate area to be cleaned.

Therefore, in accordance with the present invention, light pipe 40, which is relatively thin, is provided to direct light out front edge 26, without light bulb 24 having to be over suction chamber 20.

Light pipe 40 is preferably made of an optical grade plastic such as polymethyl methacrylate, which has an index of refraction of about 1.489. Entrance end 33 of light pipe 40 is preferably shaped to allow light rays from bulb 24 to enter easily into light pipe 40.

The upper and lower surfaces 60, 61 of light pipe 40 bear a pattern of primary reflex prismatic elements 50 and secondary reflex prismatic elements 51. Primary prismatic elements 50 preferably extend along lines that radiate from a point that is preferably centered on the filament of bulb 24, and are provided to collimate and channel light uniformly from bulb 24 to the front exit end 41 of light pipe 40. That prevents a concentration of light directly in front of bulb 24, spreading the light across the width of light pipe 40.

The apex angle of primary prismatic elements 50 is chosen with regard to the index of refraction of the material of light pipe 40 and the desired channeling effect. If the apex angle is too small, the sides of elements 50 will be too steep and light may escape, but if the apex angle is too large, the sides of elements 50 may be too shallow to provide the desired channeling. In a particularly preferred embodiment, the apex angle is between about 89.5° and about 90.5°.

As primary elements 50 extend away from entrance end 33, because they are extending radially from a point, they diverge. If this divergence were not compensated for, it would result in gaps at exit end 41 between the ends of the various prismatic elements 50. When the headlight was operating, such gaps would manifest themselves as dark, or dim, spots between the bright spots formed by elements 50. To eliminate such a pattern of alternating bright and dim spots, secondary reflex prismatic elements 51 are provided.

The cross section of secondary prismatic elements 51 is preferably mathematically similar to that of primary prismatic elements 50, with the same particularly preferred apex angle of between about 89.5° and about 90.5°. However, because secondary prismatic elements 51 are designed to fill the increasingly wide gaps between primary prismatic elements 50, the cross section of each secondary prismatic element 51 preferably begins as substantially a point, and increases in size gradually, until it reaches exit end 41. (Actually, the cross section of each of primary prismatic elements 50 also starts substantially as a point at its virtual origin, centered on the filament of bulb 24, and increases as it extends toward exit end 41.) Secondary prismatic elements 51 pick up light rays that stray into the voids between primary prismatic elements 50 and direct them to exit end 41, resulting in a substantially uniformly bright illumination at exit end 41.

Exit end 41 of light pipe 40 is preferably formed at an incline, with the top further back than the bottom. This results in refraction of exiting light rays downward, so that the surface to be cleaned can be illuminated immediately in front of motor-driven nozzle 10. The angle of inclination in the preferred embodiment is about 17°.

Light pipe 40 can be molded or otherwise formed as a single piece. However, especially when molding light pipe 40 from an optical grade plastic, it is advantageous to form light pipe 40 in two pieces, i.e., an upper half-pipe 120 and a lower half-pipe 121, as best seen in FIG. 12 and FIGS. 6–8. Molding light pipe 40 as two half-pipes 120, 121 allows faster cooling of light pipe 40, as it is well known that a given volume cools faster as smaller pieces than as a single larger volume. Moreover, the two half-pipes 120, 121 function as independent waveguides, and as discussed above, the narrower the waveguide, the smaller the fraction of entering light rays that will escape through the sides.

The lower surface 122 of upper half-pipe 120 and the upper surface 123 of lower half-pipe 121 meet along parting plane 62. Preferably surfaces 122, 123 are perfectly smooth and flat and meet perfectly along plane 62. However, it is acceptable if upper and lower half-pipes 120, 121 meet perfectly only at front and rear edges 33, 41. If half-pipes 120, 121 fail to meet at either edge 33, 41, the direct glare of bulb 24 may be visible to the user when bulb 24 is illuminated. If half-pipes 120, 121 fail to meet at front edge 41, whether or not they meet at rear edge 33, there will be an unsightly gap. It is of little consequence, however, whether or not surfaces 122, 123 meet along all of plane 62, because, as long as each surface 122, 123 is smooth and nearly flat, light will stay within the respective half-pipe 120, 121 even if surfaces 122, 123 are not perfectly flat.

Figure 5:
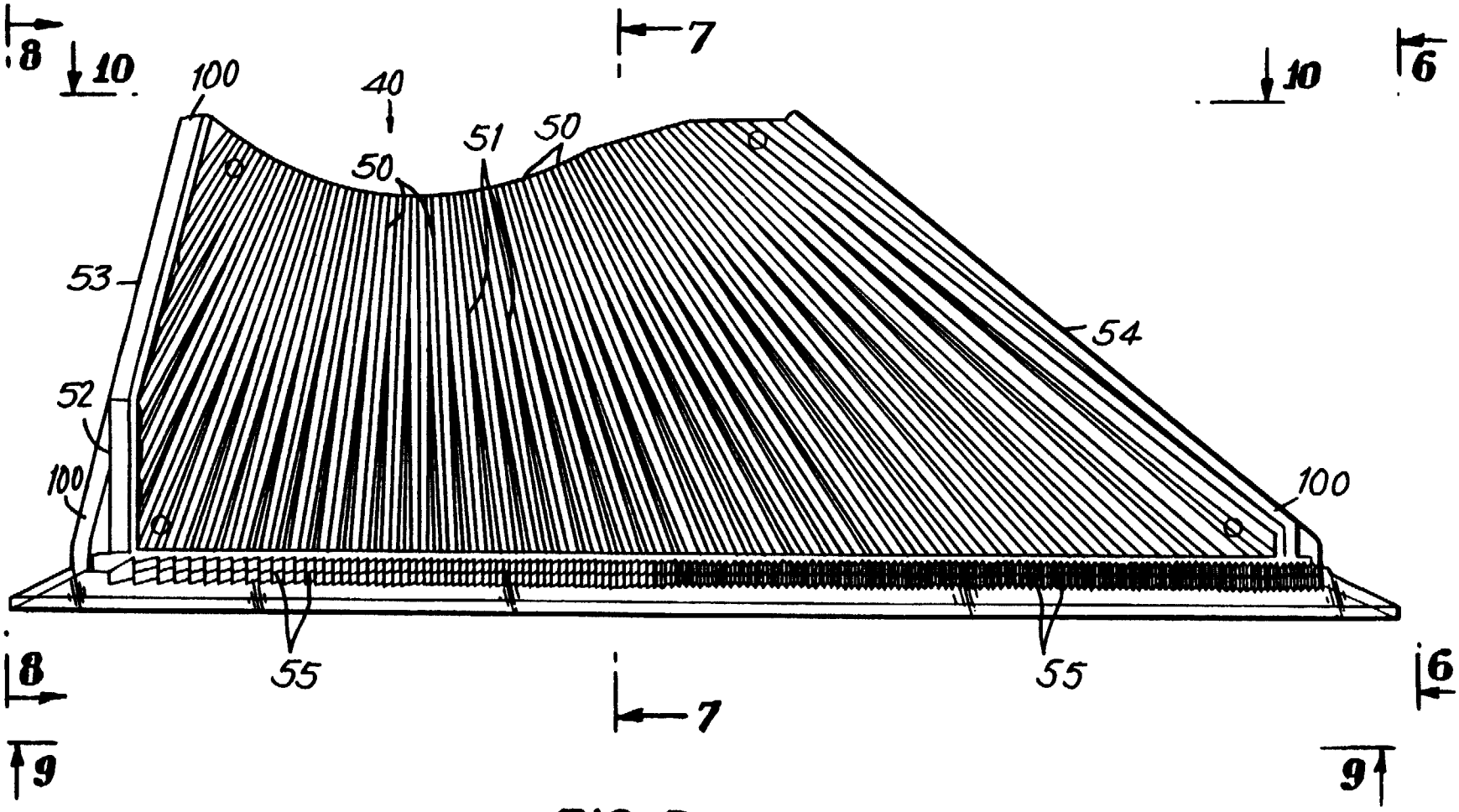
FIG. 5 is a top plan view of the light pipe of FIG. 4, taken from line 5—5 of FIG. 4.
Figure 6:
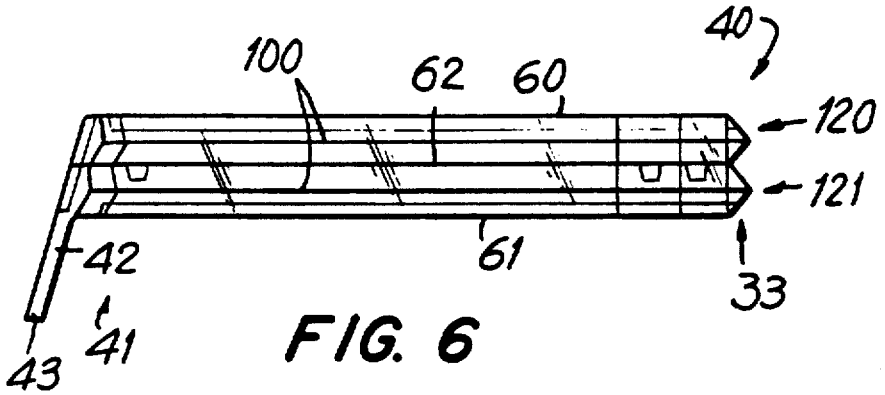
FIG. 6 is a right side elevational view of the light pipe of FIGS. 4 and 5, taken from line 6—6 of FIG. 5.
Figure 7:
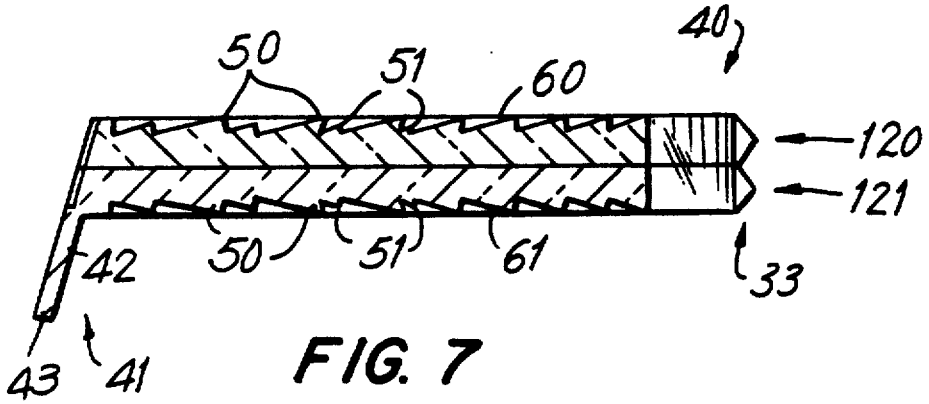
FIG. 7 is a vertical cross-sectional view of the light pipe of FIGS. 4–6, taken from line 7—7 of FIG. 5.
Figure 8:
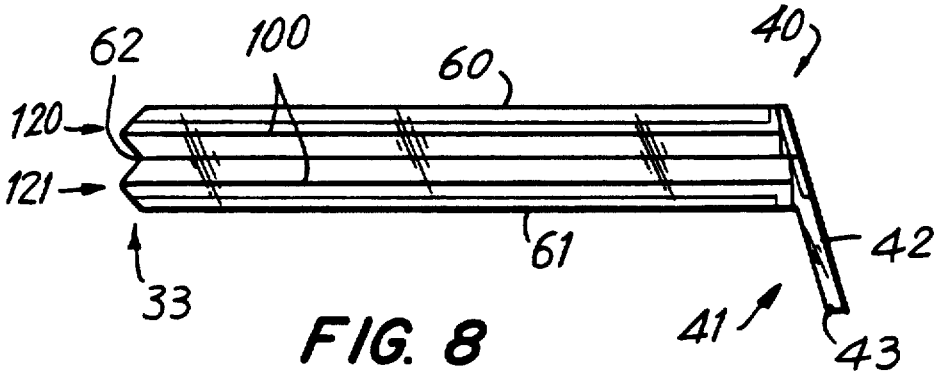
FIG. 8 is a left side elevational view of the light pipe of FIGS. 4–7, taken from line 8-8 of FIG. 5.
Figure 9:
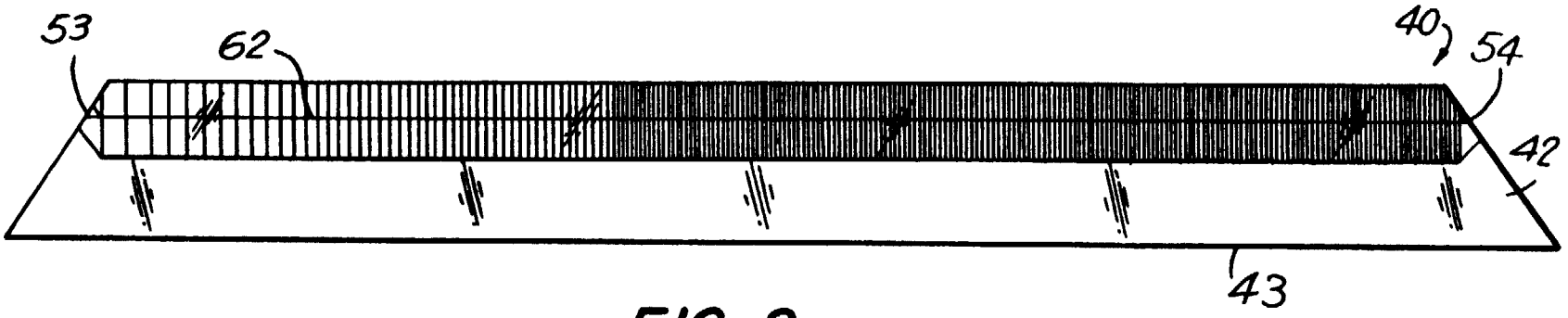
FIG. 9 is a front elevational view of the light pipe of FIGS. 4–8, taken from line 9—9 of FIG. 5.
Figure 10:
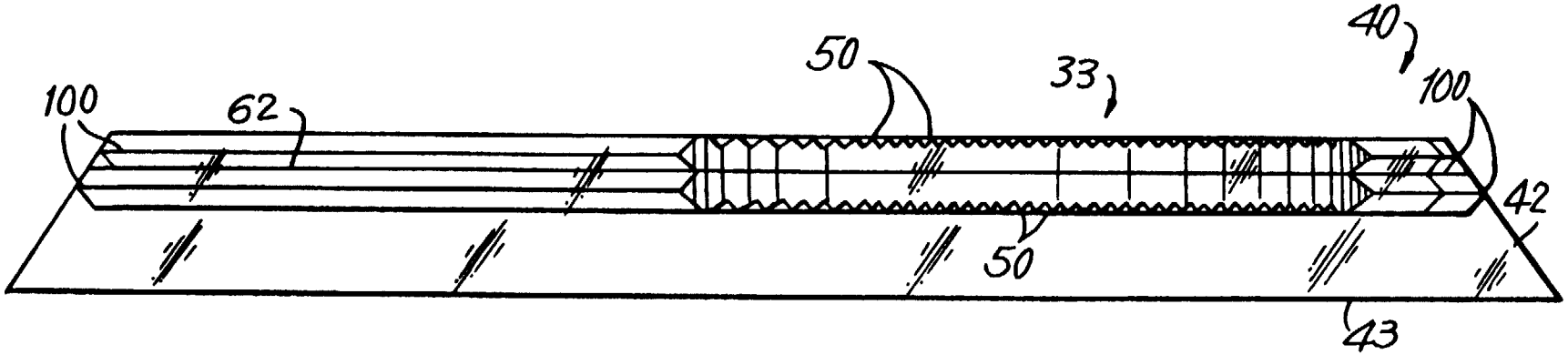
FIG. 10 is a rear elevational view of the light pipe of FIGS. 4–9, taken from line 10—10 of FIG. 5.
Figure 11:
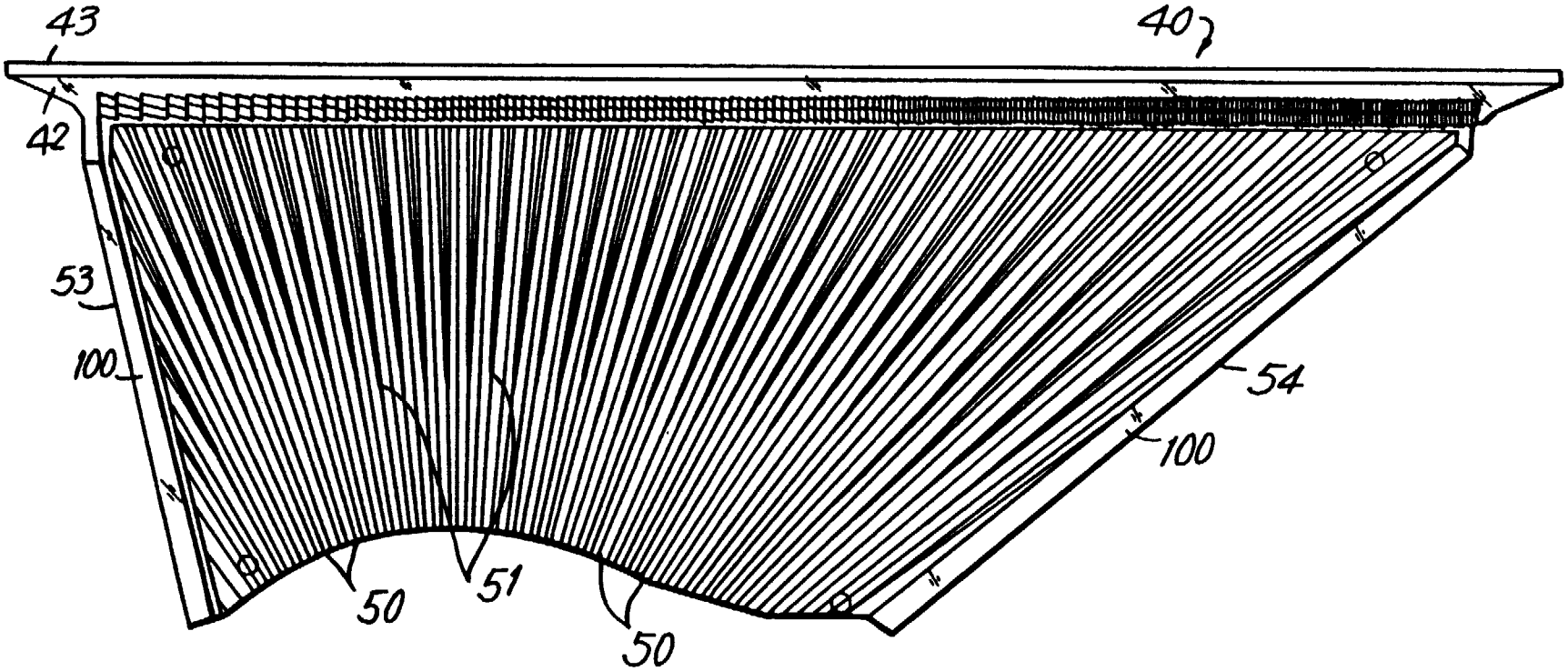
FIG. 11 is a bottom plan view of the light pipe of FIGS. 4–10, taken from line 11—11 of FIG. 4.
Figure 12:
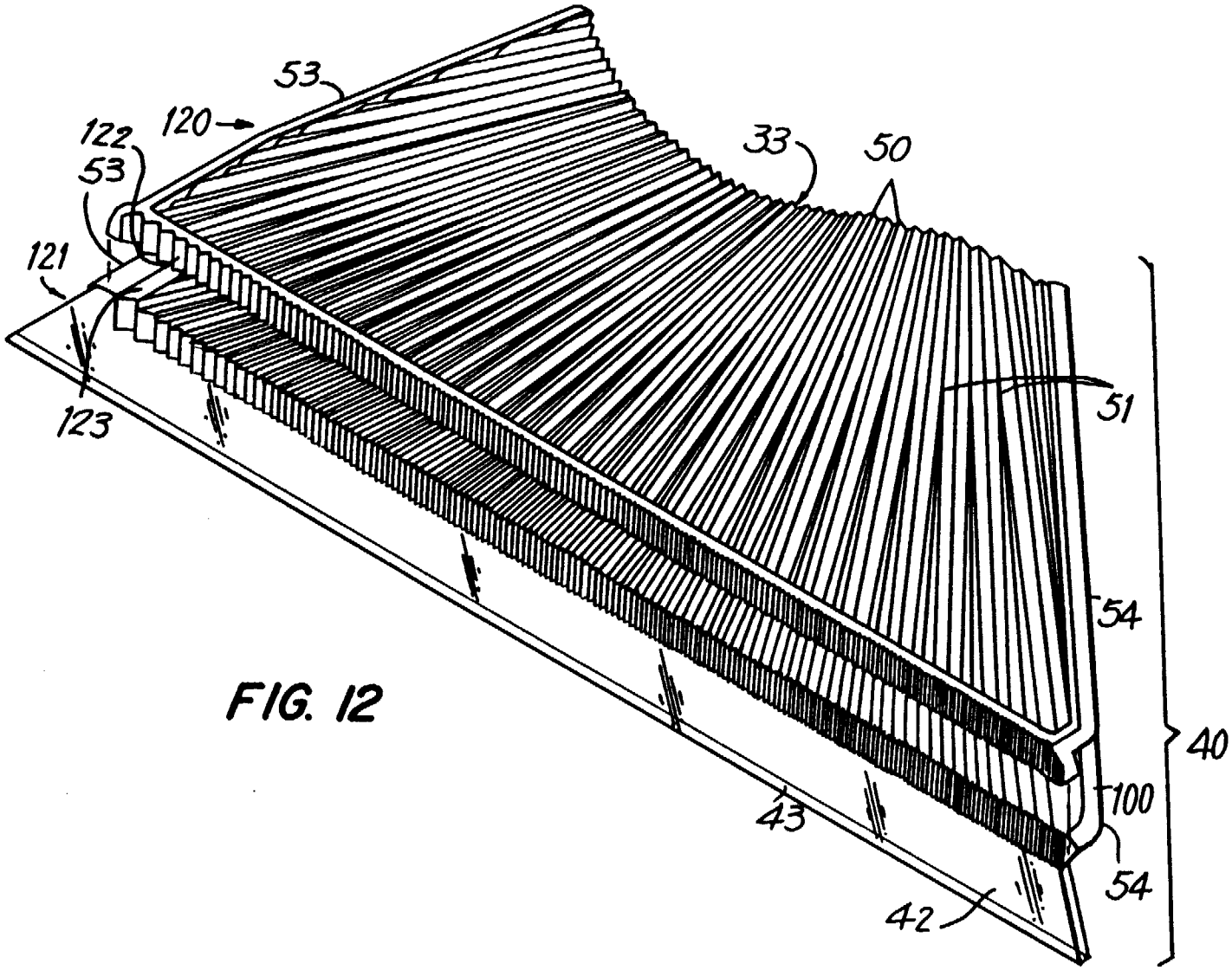
FIG. 12 is an exploded perspective view of the light pipe of FIGS. 4–11.
Figure 13:
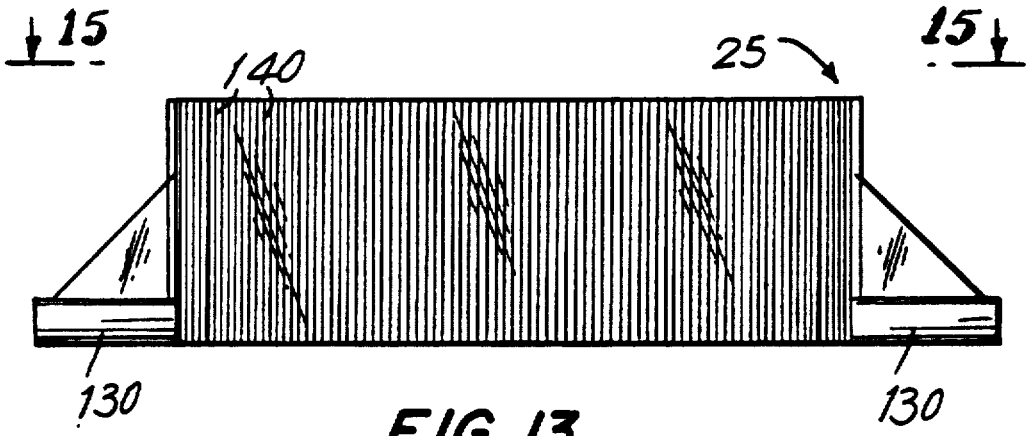
FIG. 13 is a front elevational view of a reflex optical reflector according to the present invention.
Figure 14:
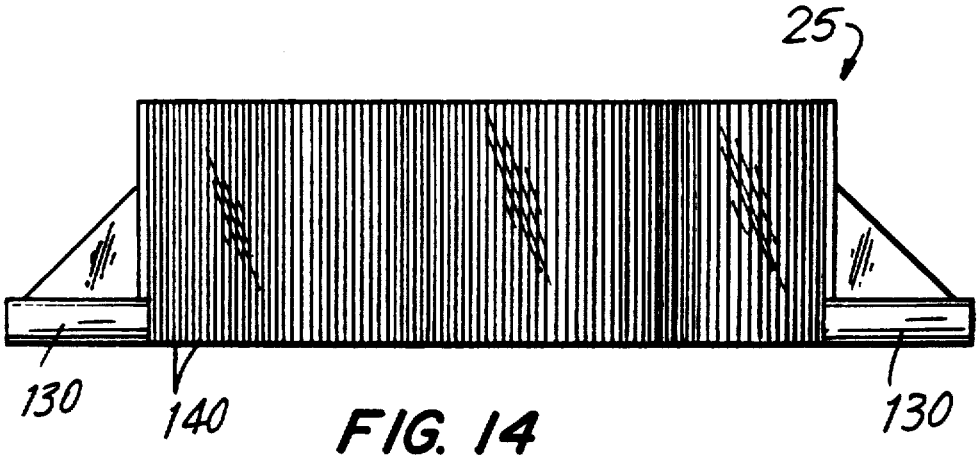
FIG. 14 is a rear elevational view of a reflex optical reflector according to the present invention.
Figure 15:
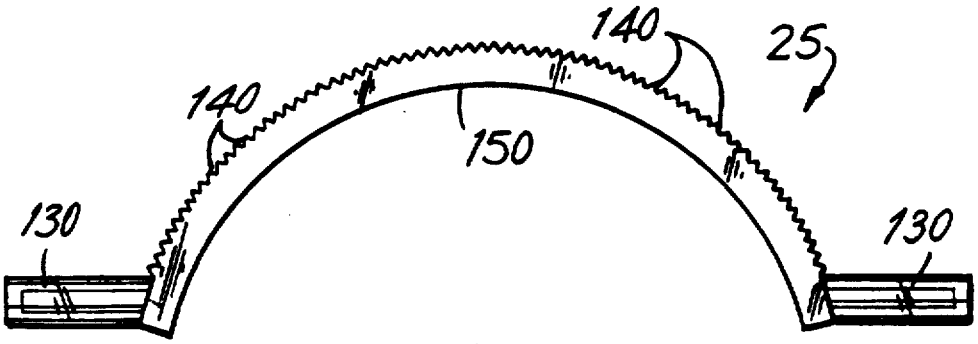
FIG. 15 is a top plan view of a reflex optical reflector according to the present invention, taken from line 15—15 of FIG. 13.

As best seen in FIG. 5, the horizontal cross section of upper half-pipe 120 is not identical to that of lower half-pipe 121. Upper half-pipe 120 has indentation 52 at side 53. Indentation 52 is provided solely to enable light pipe 40 to fit within the housing of motor-driven nozzle 10 without interfering with sloping surface 13. Front face 41 of upper half-pipe 120 is extended over indentation 52. In a motor-driven nozzle of different design, indentation 52 may not be necessary.

Upper and lower half-pipes 120, 121 may be fastened together in any convenient way that does not interfere with their optical function or with their proper fit with one another. For example, an adhesive that is effective in a thin layer may be used, or mechanical clips may be applied around the outside edges of sides 53, 54. Mechanical clips that extend into half-pipes 120, 121 may also be used, but may create baffles or shadows inside light pipe 40 that decrease the uniformity of light distribution. The most preferred method of fastening, however, is to provide posts on one of the half-pipes and corresponding holes in the other half-pipe (not shown). The posts are aligned to engage the holes in a press fit manner to hold the half-pipes together. Even where adhesive or clips are used, it may be advantageous to provide short posts and corresponding holes for alignment purposes.

In the preferred embodiment, as illustrated in the Figures, lower half-pipe 121 has depending flange 42. Flange 42 is provided solely for decorative purposes and in the illustrated embodiment is clear. As a result, when the headlight system is operating, bottom edge 43 of flange 42 is illuminated. It is also possible to provide other decorative treatments on flange 42, including ribs, grooves, matte stripes, etc.

Even with the provision of prismatic elements 50, 51, some of the light entering at end 33 may tend to stray out sides 53, 54 of light pipe 40. That is particularly so in the case of certain of elements 50, 51 that, because they follow strictly radial lines from bulb 24, terminate at side 53 or side 54, rather than at front edge 41. Accordingly, light pipe 40 is preferably provided with supplemental reflex prismatic elements 100 at sides 53, 54.

Supplemental reflex prismatic elements 100 are designed to capture, by total internal reflection, any such stray or misdirected light rays, and channel them either back into the body of light pipe 40 or along sides 53, 54 to front exit edge 41. In the preferred embodiment having two half-pipes 120, 121, supplemental elements 100 are provided on the side edges of both half-pipes 120, 121. As in the case of primary and secondary prismatic elements 50, 51, the cross section of each supplemental prismatic element 100 is preferably an isosceles triangle whose apex angle is chosen to assure the proper amount of internal reflection while still allowing the desired channeling. In a particularly preferred embodiment, the apex angle is between about 89.5° and about 90.5°.

Because light pipe 40 does not extend across the full width of motor-driven nozzle 10, it would not ordinarily illuminate the entire surface immediately in front of motor-driven nozzle 10. In order to provide such illumination, exit edge 4 of light pipe 40 is formed with prismatic shifting elements 55, which are angled to refract exiting light rays, preferably by varying angular amounts, toward the area 14 of motor-driven nozzle 10 to which light pipe 40 does not extend. Prismatic shifting elements 55 preferably are of progressively smaller angle as one proceeds from side 53 toward side 54. In the preferred embodiment, prismatic shifting elements 55 are divided into nineteen groups. In that preferred embodiment, proceeding from group to group from side 53 toward side 54, the prism angle facing side 54 increases from about 14.65° to about 75.0°, and proceeding from side 54 to side 53, the prism angle facing side 53 ranges from about 15.0° to about 90.0°. The angles are chosen to assure that area 14 is illuminated, as well as to assure that areas not directly in front of nozzle 10 are not needlessly illuminated. In addition, some of the groups near the center of exit end 41 are preferably inclined at a greater angle than the approximately 17° inclination of the remaining groups, to provide more effective illumination of the surface to be cleaned immediately in front of nozzle 10.

The effects of shifting elements 55 are shown in FIG. 1, where area 16 represents the area that would be illuminated in the absence of shifting elements 55, while area 17 represents the area illuminated when shifting elements 55 are provided.

In the preferred embodiment of light pipe 40 having upper and lower half-pipes 120, 121, shifting elements 55 are provided on both half-pipes 120, 121. However, it is possible to provide shifting elements 55 on only one of half-pipes 120, 121.

As stated above, reflex optical reflector 25 is provided to better utilize the light from bulb 24. Reflector 25 is made reflective by providing a plurality of prismatic reflecting elements 140 on the rear surface of reflector 25 (away from bulb 24), in place of the traditional metallization applied to such surfaces in conventional mirrors. This decreases the absorption caused by traditional metallization techniques such as vacuum metallization. All of the material of reflector 25 is intrinsically transparent. However, the apex angle of each of elements 140 is preferably chosen so that substantially all light rays entering face 150 of reflector 25 are reflected back toward bulb 24 and entrance edge 33 of light pipe 40. Tabs 130 are provided for attaching reflector 25 to motor-driven nozzle 10.

The horizontal cross section of face 150 is preferably a circular arc, most preferably a semicircle, substantially centered on the filament of bulb 24 (i.e., substantially the same virtual center point from which elements 50, 51 radiate). Ideally, reflector 25 should be part-spherical; however, with the dimensions involved in motor-driven nozzle 10, a part-cylindrical shape is a sufficient approximation. In this case, all light rays are impinging substantially normally on surface 150 and continuing back to elements 140. It is desired that no light ray impinge on a side of any element 140 at less than 41.8° from the normal, or more than 48.2° from the surface of that side. Hence the preferred apex angle is no greater than 96.4° (twice 48.2°). The particularly preferred apex angle is between about 89.5° and about 90.5°.

Reflector 25 increases the amount of light entering light pipe 40. The semicircular shape directs reflected light rays into light pipe 40 at substantially the same angle as direct light from bulb 24. Accordingly, the available light is increased while the number of stray rays that would affect the uniformity of light distribution is minimized.

Thus it is seen that a vacuum cleaner headlight which does not excessively increase the height of the front of a vacuum cleaner, which illuminates the area immediately in front of the vacuum cleaner, and which has an effective distribution of light across the width of the vacuum cleaner, as well as a vacuum cleaner, incorporating a light pipe, which only requires one light pipe and one light bulb or other light source, are provided. One skilled in the art will appreciate that the present invention can be practiced by other than the described embodiments, which are presented for purposes of illustration and not of limitation, and the present invention is limited only by the claims which follow.

What is claimed is:

1. A vacuum cleaner assembly, comprising:

a housing having a front wall;

a light pipe chamber within said housing communicating with a headlight aperture in said front wall;

a light source within said housing remote from said headlight aperture; and a substantially planar light pipe within said light pipe chamber, said light pipe having:

a first index of refraction;

a rear face adjacent said light source for receiving light from said light source, a front face disposed substantially in said headlight aperture through which light is emitted, and an upper surface and a lower surface, at least one of said upper and lower surfaces having primary reflex optical elements thereon for distributing light entering said rear face in a desired distribution to said front face, said reflex optical elements being optical elements that direct light transmitted therethrough by substantially total internal reflection of said light.

2. The vacuum cleaner assembly of claim 1 wherein both of said upper and lower surfaces have said primary reflex optical elements thereon.

3. The vacuum cleaner assembly of claim 1 wherein said light pipe comprises a substantially planar upper half-pipe and a substantially planar lower half-pipe, each of said half-pipes having upper and lower surfaces, the lower surface of said upper half-pipe being complementary, and at least one of the upper surface of said upper half-pipe and the lower surface of said lower half-pipe having said primary reflex optical elements thereon.

4. The vacuum cleaner assembly of claim 3 wherein said lower surface of said upper half-pipe and said upper surface of said lower half-pipe are both substantially smooth.

5. The vacuum cleaner assembly of claim 3 wherein both said upper surface of said upper half-pipe and said lower surface of said lower half-pipe have said primary reflex optical elements thereon.

6. The vacuum cleaner assembly of claim 3 wherein both of said upper and lower half-pipes have lateral edges, at least one lateral edge of at least one of said upper and lower half-pipes having supplemental reflex optical elements for directing back into said half-pipe any light rays that would otherwise exit said lateral edge.

7. The vacuum cleaner assembly of claim 6 wherein both lateral edges of both said half-pipes have said supplemental reflex optical elements.

8. The vacuum cleaner assembly of claim 6 wherein said supplemental reflex optical elements are prismatic.

9. The vacuum cleaner assembly of claim 8 wherein each of said prismatic supplemental reflex optical elements has an isosceles-triangular cross section.

10. The vacuum cleaner assembly of claim 9 wherein said isosceles-triangular cross section has an apex angle chosen based on said first index of refraction to maximize total internal reflection of light rays attempting to exit said lateral edges.

11. The vacuum cleaner assembly of claim 10 wherein said apex angle is between about 89.5° and about 90.5°.

12. The vacuum cleaner assembly of claim 3 wherein said primary reflex optical elements extend substantially along lines diverging substantially radially from a point substantially centered on said light source.

13. The vacuum cleaner assembly of claim 12 wherein each of said primary reflex optical elements has a cross section that increases as said primary reflex optical element extends away from said point.

14. The vacuum cleaner assembly of claim 12 wherein said primary reflex optical elements are prismatic.

15. The vacuum cleaner assembly of claim 14 wherein each of said prismatic primary reflex optical elements has an isosceles-triangular cross section.

16. The vacuum cleaner assembly of claim 15 wherein said isosceles-triangular cross section of said primary reflex optical elements has an apex angle chosen based on said first index of refraction to maximize total internal reflection of light rays propagating through said primary reflex optical elements.

17. The vacuum cleaner assembly of claim 16 wherein said apex angle is between about 89.5° and about 90.5°.

18. The vacuum cleaner assembly of claim 16 further comprising secondary reflex optical elements disposed in gaps formed as said primary reflex optical elements diverge.

19. The vacuum cleaner assembly of claim 18 wherein said secondary reflex optical elements are prismatic.

20. The vacuum cleaner assembly of claim 19 wherein each of said prismatic secondary reflex optical elements has an isosceles-triangular cross section.

21. The vacuum cleaner assembly of claim 20 wherein said isosceles-triangular cross section of said secondary reflex optical elements has an apex angle chosen based on said first index of refraction to maximize total internal reflection of light rays propagating through said secondary reflex optical elements.

22. The vacuum cleaner assembly of claim 21 wherein said apex angle is between about 89.5° and about 90.5°.

23. The vacuum cleaner assembly of claim 2 wherein said apex angle of said isosceles-triangular cross section of said secondary reflex optical elements is substantially identical to said apex angle of said isosceles-triangular cross section of said primary reflex optical elements.

24. The vacuum cleaner assembly of claim 20 wherein the cross section of each of said secondary reflex optical elements increases with increasing distance from said point.

25. The vacuum cleaner assembly of claim wherein said light pipe has lateral edges, at least one lateral edge of said light pipe having supplemental reflex optical elements for directing back into said light pipe any light rays that would otherwise exit said lateral edge.

26. The vacuum cleaner assembly of claim 25 wherein both lateral edges of said light pipe has said supplemental reflex optical elements.

27. The vacuum cleaner assembly of claim 25 wherein said supplemental reflex optical elements are prismatic.

28. The vacuum cleaner assembly of claim 27 wherein each of said prismatic supplemental reflex optical elements has an isosceles-triangular cross section.

29. The vacuum cleaner assembly of claim 28 wherein said isosceles-triangular cross section has an apex angle chosen based on said first index of refraction to maximize total internal reflection of light rays attempting to exit said lateral edges.

30. The vacuum cleaner assembly of claim 29 wherein said apex angle is between about 89.5° and about 90.5°.

31. The vacuum cleaner assembly of claim 1 wherein said primary reflex optical elements extend substantially along lines diverging substantially radially from point substantially centered on said light source.

32. The vacuum cleaner assembly of claim 31 wherein each of said primary reflex optical elements has a cross section that increases as said primary reflex optical element extends away from said point.

33. The vacuum cleaner assembly of claim 31 wherein said primary reflex optical elements are prismatic.

34. The vacuum cleaner assembly of claim 33 wherein each of said prismatic primary reflex optical elements has an isosceles-triangular cross section.

35. The vacuum cleaner assembly of claim 34 wherein said isosceles-triangular cross section of said primary reflex optical elements has an apex angle chosen based on said first index of refraction to maximize total internal reflection of light rays propagating through said primary reflex optical elements.

36. The vacuum cleaner assembly of claim 35 wherein said apex angle is between about 89.5° and about 90.5°.

37. The vacuum cleaner assembly of claim 35 further comprising secondary reflex optical elements disposed in gaps formed as said primary reflex optical elements diverge.

38. The vacuum cleaner assembly of claim 37 wherein said secondary reflex optical elements are prismatic.

39. The vacuum cleaner assembly of claim 38 wherein each of said prismatic secondary reflex optical elements has an isosceles-triangular cross section.

40. The vacuum cleaner assembly of claim 39 wherein said isosceles-triangular cross section of said secondary reflex optical elements has an apex angle chosen based on said first index of refraction to maximize total internal reflection of light rays propagating through said secondary reflex optical elements.

41. The vacuum cleaner assembly of claim 40 wherein said apex angle is between about 89.5° and about 90.5°.

42. The vacuum cleaner assembly of claim 40 wherein said apex angle of said isosceles-triangular cross section of said secondary reflex optical elements is substantially identical to said apex angle of said isosceles-triangular cross section of said primary reflex optical elements.

43. The vacuum cleaner assembly of claim 39 wherein the cross section of each of said secondary reflex optical elements increases with increasing distance from said point.

44. The vacuum cleaner assembly of claim 1 wherein said light pipe further comprises a plurality of prismatic shifting elements on said front face for changing direction of light rays transmitted through said front face.

45. The vacuum cleaner assembly of claim 44 wherein said prismatic shifting elements shift light rays laterally relative to said light pipe.

46. The vacuum cleaner assembly of claim 44 wherein said prismatic shifting elements vary in size across said front face.

47. The vacuum cleaner assembly of claim 44 wherein each of said prismatic shifting elements has an apex angle, said prismatic shifting elements varying in apex angle across said front face.

48. The vacuum cleaner assembly of claim 44 wherein the lateral extent of said front face is substantially completely occupied by said prismatic shifting elements.

49. The vacuum cleaner assembly of claim 44 wherein said light pipe comprises a substantially planar upper half-pipe and a substantially planar lower half-pipe, each of said half-pipes having a respective half-pipe front face, said prismatic shifting elements being disposed on at least one of said half-pipe front faces.

50. The vacuum cleaner assembly of claim 49 wherein said prismatic shifting elements are disposed on both of said half-pipe front faces.

51. The vacuum cleaner assembly of claim 1 wherein said front face of said light pipe is inclined, being further back adjacent said top surface than adjacent said bottom surface.

52. The vacuum cleaner assembly of claim 51 wherein said front face is inclined at an angle of about 17°.

53. The vacuum cleaner assembly of claim 51 wherein portions of said front face are inclined at a greater angle than other portions.

54. The vacuum cleaner assembly of claim 1 wherein said housing has an underside and a suction chamber communicating with a suction opening in said underside adjacent said front wall, said light pipe and said headlight aperture being situated above said suction chamber, whereby said light pipe allows said light source to be situated remote from said front wall, thereby imparting a low profile to said vacuum cleaner assembly at said front wall as compared to a vacuum cleaner assembly in which said light source is situated at said front wall above said suction chamber.

55. The vacuum cleaner assembly of claim 1 further comprising a reflex optical reflector spaced from said light source in a direction away from said front wall, for reflecting light toward said rear face of said light pipe, said reflex optical reflector comprising:

a substantially transparent part cylindrical element having:

an axis substantially centered on said light source, a second index of refraction, a surface facing said light source, and a surface away from said light source; and a plurality of reflex optical elements on said surface away from said light source, said reflex optical elements extending substantially parallel to said axis.

56. The vacuum cleaner system of claim 55 wherein said reflex optical elements of said reflex optical reflector are prismatic.

57. The vacuum cleaner assembly of claim 56 wherein each of said prismatic reflex optical elements has an isosceles-triangular cross section.

58. The vacuum cleaner assembly of claim 57 wherein said isosceles-triangular cross section has an apex angle chosen based on said second index of refraction to maximize total internal reflection of light rays attempting to exit said surface away from said light source.

59. The vacuum cleaner assembly at claim 58 wherein said apex angle is less than about 96.4°.

60. The vacuum cleaner assembly of claim 59 wherein said apex angle is between about 89.5° and about 90.5°.

61. The vacuum cleaner assembly of claim 55 wherein said surface away from said light source is substantially completely occupied by said plurality of reflex optical elements.

62. For use in a vacuum cleaner assembly having a light source, a reflex optical reflector spaced from said light source in a first direction, for reflecting light in a second direction opposite said first direction, said reflex optical reflector comprising:

a substantially transparent part-cylindrical element having:

an axis substantially centered on said light source, an index of refraction, a surface facing said light source, and a surface away from said light source; and a plurality of reflex optical elements on said surface away from said light source, said reflex optical elements extending substantially parallel to said axis, said reflex optical elements being optical elements that direct light transmitted therethrough by substantially total internal reflection of said light.

63. The reflex optical reflector of claim 62 wherein said reflex optical elements are prismatic.

64. The reflex optical reflector of clam 63 wherein each of said prismatic reflex optical elements has an isosceles-triangular cross section.

65. The reflex optical reflector of claim 64 wherein said isosceles-triangular cross section has an apex angle chosen based on said index of refraction to maximize total internal reflection of light rays attempting to exit said surface away from said light source.

66. The reflex optical reflector of claim 65 wherein said apex angle is less than about 96.4°.

67. The reflex optical reflector of claim 66 wherein said apex angle is between about 89.5° and about 90.5°.

68. The reflex optical reflector of claim 62 wherein said surface away from said light source is substantially completely occupied by said plurality of reflex optical elements.

69. For use in a vacuum cleaner assembly including a housing having a front wall, a headlight aperture in said front wall, and a light source within said housing remote from said headlight aperture, for disposition between said light source and said headlight aperture for propagating light therebetween, a substantially planar light pipe, said light pipe comprising:

an index of refraction;

a rear face adjacent said light source for receiving light from said light source, a front face disposed substantially in said headlight aperture through which light is emitted, and an upper surface and a lower surface, at least one of said upper and lower surfaces having primary reflex optical elements thereon for distributing light entering said rear face in a desired distribution to said front face, said reflex optical elements being optical elements that direct light transmitted therethrough by substantially total internal reflection of said light.

70. The light pipe of claim 69 wherein both of said upper and lower surfaces have said primary reflex optical elements thereon.

71. The light pipe of claim 69 wherein said light pipe comprises a substantially planar upper half-pipe and a substantially planar lower half-pipe, each of said half-pipes having upper and lower surfaces, the lower surface of said upper half-pipe and the upper surface of said lower half-pipe being complementary, and at least one of the upper surface of said upper half-pipe and the lower surface of said lower half-pipe having said primary reflex optical elements thereon.

72. The light pipe of claim 71 wherein said lower surface of said upper half-pipe and said upper surface of said lower half-pipe are both substantially smooth.

73. The light pipe of claim 71 wherein both said upper surface of said upper half-pipe and said lower surface of said lower half-pipe have said primary reflex optical elements thereon.

74. The light pipe of claim 71 wherein both of said upper and lower half-pipes have lateral edges, at least one lateral edge of at least one of said upper and lower half-pipes having supplemental reflex optical elements for directing back into said half-pipe any light rays that would otherwise exit said lateral edge.

75. The light pipe of claim 74 wherein both lateral edges of both said half-pipes have said supplemental reflex optical elements.

76. The light pipe of claim 74 wherein said supplemental reflex optical elements are prismatic.

77. The light pipe of claim 76 wherein each of said prismatic supplemental reflex optical elements has an isosceles-triangular cross section.

78. The light pipe of claim 77 wherein said isosceles-triangular cross section has an apex angle chosen based on said first index of refraction to maximize total internal reflection of light rays attempting to exit said lateral edges.

79. The light pipe of claim 78 wherein said apex angle is between about 89.5° and about 90.5°.

80. The light pipe of claim 71 wherein said primary reflex optical elements extend substantially along lines diverging substantially radially from a point off said light pipe, divergence of said primary reflex optical elements increasing from said rear face toward said front face.

81. The light pipe of claim 80 wherein each of said primary reflex optical elements has a cross section that increases as said primary reflex optical element extends away from said point.

82. The light pipe of claim 81 wherein said primary reflex optical elements are prismatic.

83. The light pipe of claim 82 wherein each of said prismatic primary reflex optical elements has an isosceles-triangular cross section.

84. The light pipe of claim 83 wherein said isosceles-triangular cross section of said primary reflex optical elements has an apex angle chosen based on said index of refraction to maximize total internal reflection of light rays propagating through said primary reflex optical elements.

85. The light pipe of claim 84 wherein said apex angle is between about 89.5° and about 90.5°.

86. The light pipe of claim 84 further comprising secondary reflex optical elements disposed in gaps formed as said primary reflex optical elements diverge.

87. The light pipe of claim 86 wherein said secondary reflex optical elements are prismatic.

88. The light pipe of claim 87 wherein each of said prismatic secondary reflex optical elements has an isosceles-triangular cross section.

89. The light pipe of claim 88 wherein said isosceles-triangular cross section of said secondary reflex optical elements has an apex angle chosen based on said index of refraction to maximize total internal reflection of light rays propagating through said secondary reflex optical elements.

90. The light pipe of claim 89 wherein said apex angle is between about 89.5° and about 90.5°.

91. The light pipe of claim 89 wherein said apex angle of said isosceles-triangular cross section of said secondary reflex optical elements is substantially identical to said apex angle of said isosceles-triangular cross section of said primary reflex optical elements.

92. The light pipe of claim 88 wherein the cross section of each of said secondary reflex optical elements increases with increasing distance from rear face.

93. The light pipe of claim 69 wherein said light pipe has lateral edges, at least one lateral edge of said light pipe having supplemental reflex optical elements for directing back into said light pipe any light rays that would otherwise exit said lateral edge.

94. The light pipe of claim 93 wherein both lateral edges of said light pipe has said supplemental reflex optical elements.

95. The light pipe of claim 93 wherein said supplemental reflex optical elements are prismatic.

96. The light pipe of claim 95 wherein each of said prismatic supplemental reflex optical elements has an isosceles-triangular cross section.

97. The light pipe of claim 96 wherein said isosceles-triangular cross section has an apex angle chosen based on said first index of refraction to maximize total internal reflection of light rays attempting to exit said lateral edges.

98. The light pipe of claim 97 wherein said apex angle is between about 89.5° and about 90.5°.

99. The light pipe of claim 69 wherein said primary reflex optical elements extend substantially along lines diverging substantially radially from a point off said light pipe, divergence of said primary reflex optical elements increasing from said rear face toward said front face.

100. The light pipe of claim 99 wherein each of said primary reflex optical elements has a cross section that increases as said primary reflex optical element extends away from said point.

101. The light pipe of claim 100 wherein said primary reflex optical elements are prismatic.

102. The light pipe of claim 101 wherein each of said prismatic primary reflex optical elements has an isosceles-triangular cross section.

103. The light pipe of claim 102 wherein said isosceles-triangular cross section of said primary reflex optical elements has an apex angle chosen based on said index of refraction to maximize total internal reflection of light rays propagating through said primary reflex optical elements.

104. The light pipe of claim 103 wherein said apex angle is between about 89.5° and about 90.5°.

105. The light pipe of claim 103 further comprising secondary reflex optical elements disposed in gaps formed as said primary reflex optical elements diverge.

106. The light pipe of claim 105 wherein said secondary reflex optical elements are prismatic.

107. The light pipe of claim 106 wherein each of said prismatic secondary reflex optical elements has an isosceles-triangular cross section.

108. The light pipe of claim 107 wherein said isosceles-triangular cross section of said secondary reflex optical elements has an apex angle chosen based on said index of refraction to maximize total internal reflection of light rays propagating through said secondary reflex optical elements.

109. The light pipe of claim 108 wherein said apex angle is between about 89.5° and about 90.5°.

110. The light pipe of claim 108 wherein said apex angle of said isosceles-triangular cross section of said secondary reflex optical elements is substantially identical to said apex angle of said isosceles-triangular cross section of said primary reflex optical elements.

111. The light pipe of claim 107 wherein the cross section of each of said secondary reflex optical elements increases with increasing distance from said rear face.

112. The light pipe of claim 69 further comprising a plurality of prismatic shifting elements on said front face for changing direction of light rays transmitted through said front face.

113. The light pipe of claim 112 wherein said prismatic shifting elements shift light rays laterally relative to said light pipe.

114. The light pipe of claim 112 wherein said prismatic shifting elements vary in size across said front face.

115. The light pipe of claim 112 wherein each of said prismatic shifting elements has an apex angle, said prismatic shifting elements varying in apex angle across said front face.

116. The light pipe of claim 112 wherein the lateral extent of said front face is substantially completely occupied by said prismatic shifting elements.

117. The light pipe of claim 112 comprising a substantially planar upper half-pipe and a substantially planar lower half-pipe, each of said half-pipes having a respective half-pipe front face, said prismatic shifting elements being disposed on at least one of said half-pipe front faces.

118. The vacuum cleaner assembly of claim 117 wherein said prismatic shifting elements are disposed on both of said half-pipe front faces.

119. The light pipe of claim 69 wherein said front face is inclined, being further back adjacent said top surface than adjacent said bottom surface.

120. The light pipe of claim 119 wherein said front face is inclined at an angle of about 17°.

121. The light pipe of claim 119 wherein portions of said front face are inclined at a greater angle than other portions.

122. The light pipe of claim 69 wherein:

when:

said light pipe is used in a housing having a front wall, an underside, a headlight aperture in said front wall, a light source for emitting light through said headlight aperture, and a suction chamber communicating with a suction opening in said underside adjacent said front wall, and said light pipe and said headlight aperture are situated above said suction chamber:

said light pipe allows said light source to be situated remote from said front wall, thereby imparting a low profile to said housing at said front wall as compared to a housing in which said light source is situated at said front wall above said suction chamber.

* * * * *

UNITED STATES PATENT AND TRADEMARK OFFICE

CERTIFICATE OF CORRECTION

PATENT NO. : 5,207,498

DATED : May 4, 1993

INVENTOR(S) : Randall K. Lawrence et al.

It is certified that error appears in the above-indentified patent and that said Letters Patent is hereby corrected as shown below:

Column 3, line 23, "Snel's" should be -- Snell's --.

Column 7, line 51, "4" should be -- 41 --.

Claim 3, column 9, line 27, after "half-pipe" should be inserted -- and the upper surface of said lower half-pipe --.

Claim 59, column 12, line 60, "at" should be -- of --.

Claim 64, column 13, line 20, "clam" should be -- claim --.

Signed and Sealed this

Sixteenth Day of May, 1995

Bruce Lehman

*Attest:*

BRUCE LEHMAN

*Attesting Officer*

*Commissioner of Patents and Trademarks*